US012736300B2

(12) United States Patent
Liao

(10) Patent No.: US 12,736,300 B2
(45) Date of Patent: Sep. 15, 2026

(54) AUTOMATIC SHOOTING DEVICE OF TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 159 days.

(21) Appl. No.: 18/614,753

(22) Filed: Mar. 25, 2024

(65) Prior Publication Data

US 2025/0052534 A1 Feb. 13, 2025

(30) Foreign Application Priority Data

Aug. 11, 2023 (TW) ..... 112208532

(51) Int. Cl.
*F41A 19/08* (2006.01)
*F41A 19/59* (2006.01)
(Continued)

(52) U.S. Cl.
CPC ..... *F41C 3/005* (2013.01); *F41A 19/08* (2013.01); *F41A 19/59* (2013.01); *F41A 9/02* (2013.01); *F41A 9/73* (2013.01)

(58) Field of Classification Search
CPC ..... F41A 19/08; F41A 19/59; F41A 19/58; F41A 33/02; F41A 17/08; F41A 9/02; F41A 9/73; F41C 3/005; F41B 11/71; F41B 11/89; F41B 11/50; F41B 11/52; F41G 3/2655
See application file for complete search history.

(56) References Cited

U.S. PATENT DOCUMENTS 3,703,845 A * 11/1972 Griew ..... F41A 17/08 89/134
4,577,962 A * 3/1986 de Guillenschmidt ... F41G 5/08 356/139.08

(Continued)

FOREIGN PATENT DOCUMENTS

KR 20170115651 * 10/2017 ..... F41B 11/50

OTHER PUBLICATIONS

KR 20170115651 ENG TRA, Oct. 18, 2017, Kang H.*

*Primary Examiner* — John E Simms, Jr.
(74) *Attorney, Agent, or Firm* — Birch, Stewart, Kolasch & Birch, LLP

(57) ABSTRACT

A toy gun automatic shooting device includes a laser detection device arranged at one side of a toy gun body and includes a shooting module and an electronic trigger module. A reaction device is arranged on the toy gun body and includes a shot storage module, a control substrate, and an electrical power supply unit that supplies electrical power to a control substrate of the reaction device. The control substrate receives a detection signal from the laser detection device and controls the electronic trigger module to drive the shooting module that supplies shots so as to allow the toy gun body to carry out a shooting operation. Automatic shooting made after the laser detection device detects a target object is fulfilled to enhance the fun of playing a survival game, and further, detection being made with the laser detection device fulfills higher accuracy and longer distance of detection.

9 Claims, 21 Drawing Sheets

(51) Int. Cl.

| | |
|---|---|
| ***F41C 3/00*** | (2006.01) |
| *F41A 9/02* | (2006.01) |
| *F41A 9/73* | (2006.01) |

(56) References Cited

U.S. PATENT DOCUMENTS

| | | | | | |
|---|---|---|---|---|---|
| 5,544,439 | A * | 8/1996 | Grember | F41A 19/59 | 42/114 |
| 5,966,859 | A * | 10/1999 | Samuels | F41G 3/12 | 42/70.11 |
| 6,871,439 | B1 * | 3/2005 | Edwards | F42B 5/035 | 42/84 |
| 11,953,286 | B1 * | 4/2024 | Enderle | F41A 17/48 | |
| 2007/0204745 | A1 * | 9/2007 | Son | F41A 19/00 | 89/37.03 |
| 2007/0264616 | A1 * | 11/2007 | Namgung | F41G 3/2655 | 250/206 |
| 2015/0101229 | A1 * | 4/2015 | Hall | F41A 19/58 | 42/69.01 |

* cited by examiner

AUTOMATIC SHOOTING DEVICE OF TOY GUN

BACKGROUND OF THE INVENTION

(a) Technical Field of the Invention

The present invention provides an automatic shooting device, and more particularly to an automatic shooting device of a toy gun that detects a target at a further distance in order to truly simulate the state of opponent fire and uses an electronic trigger as basis of control to effectively fulfill unmanned operation and automatic fast counter firing.

(b) Description of the Prior Art

In the modern quick-paced living, there is always a lot of stress of living and concerns of effectively relieving the stress. Entertainment activity is a measure that is often taken for relief of accumulated stress. A lot of people choose activities that are more exciting and more stimulating for the purposes of stress relief. For example, shooting games are one of the exciting ways for stress relief. However, simple person vs person combating is no longer sufficient for simulating for most people, and particularly, when the number of participants is limited, it becomes monotonous. In view of this, manufacturers have developed devices for stimulus enhancement, such as Taiwan Utility Model M382150, which discloses a survival game automatic apparatus including a management device, wherein the management device is in electrical signal connection with a sensing device, an alarm sounding device, a light emitting, a randomizer device, and an attack device. The sensing device is in electrical signal connection with a recognizing and positioning device. By means of each of the above-described devices, the difficulty and the degree of simulation of the survival games can be improved and the players' interesting can be enhanced, and paintball guns that are accidentally lost in a game can be recovered.

However, the following problems and shortcomings can be found in the use of the above-described survival game automatic apparatus:

Although the technology improves the fun and provides a function of automatic attack, yet the sensing device is subject to limit of distance. Further, the known technology uses a pull-to-trigger device for firing, rather than an electronic trigger, and this makes the overall counter firing speed not very realistic and cannot effectively simulate a real scenario. Further, there is no expanded bullet magazine, making the enduring property poor.

SUMMARY OF THE INVENTION

The primary objective of the present invention is to use a laser detection device to effectively enhance accuracy and detection distance in order to generate a more realistic scenario, and to control an electronic trigger module to drive a shooting module to perform a shooting operation so as to achieve a different way of playing a survival game to enhance the fun of game playing. Further, using the electronic trigger module makes the reaction sensitivity faster and enables change of the firing mode according to a user's need to make the playing persistency higher.

A structure of the present invention that achieves the above objective comprises a laser detection device, wherein the laser detection device is arranged at one side of a toy gun body, the toy gun body comprising a shooting module, the shooting module being operatively connected with an electronic trigger module, the toy gun body being provided with a reaction device, the reaction device comprising a shot storage module for receiving a plurality of shots therein, a control substrate arranged at one side of the shot storage module and in information connection with the laser detection device, the control substrate being mainly for receiving a signal of detection by the laser detection device and controlling the electronic trigger module to drive the shooting module to carry out the shooting operation, and further, the control substrate is in electrical connection with an electrical power supply unit.

The laser detection device, upon detecting a target object, issues a signal to the control substrate, and the control substrate, upon receiving the signal, controls the electronic trigger module to operate, so that the electronic trigger module drives the shooting module to make the toy gun body shooting, and as such, due to the advantages of high accuracy and relatively long range of detection possessed by the laser detection device, realisticity of simulation with respect to the vision of first-time observation of a real human being can be further enhanced, and the arrangement of the electronic trigger module makes reaction for shooting faster, not exhibiting any situation concerning interruption or slowness.

Based on the above-described technology, breakthroughs can be made on the prior art survival game automatic device with respect to the known technology being capable of enhancing interesting and possessing a function of automatic attack, yet the sensing device being limited for distance, and the known technology adopting pull-to-trigger device for shooting, not an electronic trigger, making the overall counter firing speed not very realistic, being not effectively simulating a real scenario, and not including an expansion magazine, making endurability poor, so as to achieve improvement of utilization for the above-discussed advantages of the present invention.

DETAILED DESCRIPTION OF THE PREFERRED EMBODIMENTS

Figure 1:
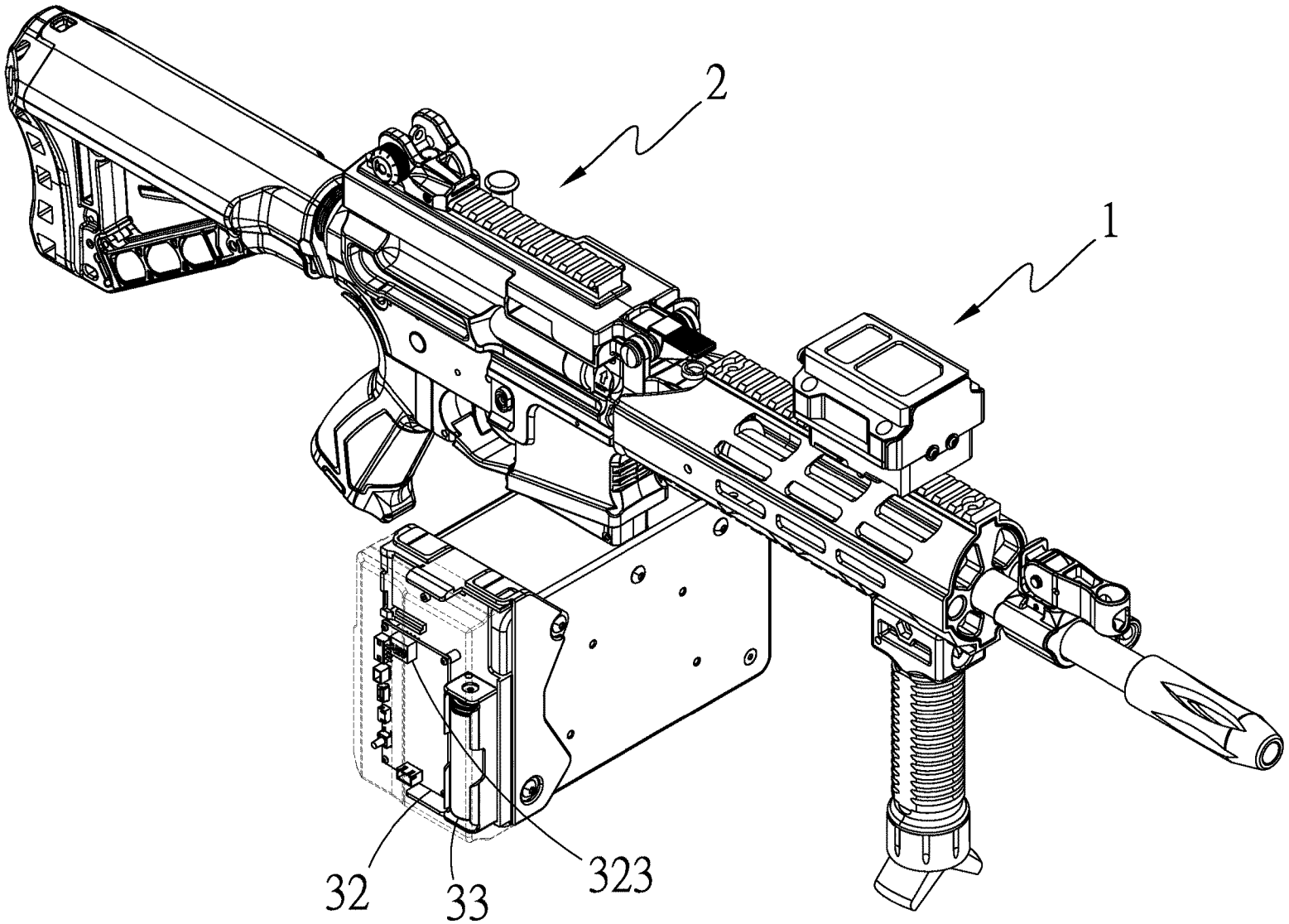
FIG. 1 is a perspective view showing a first preferred embodiment of the present invention.
Figure 2:
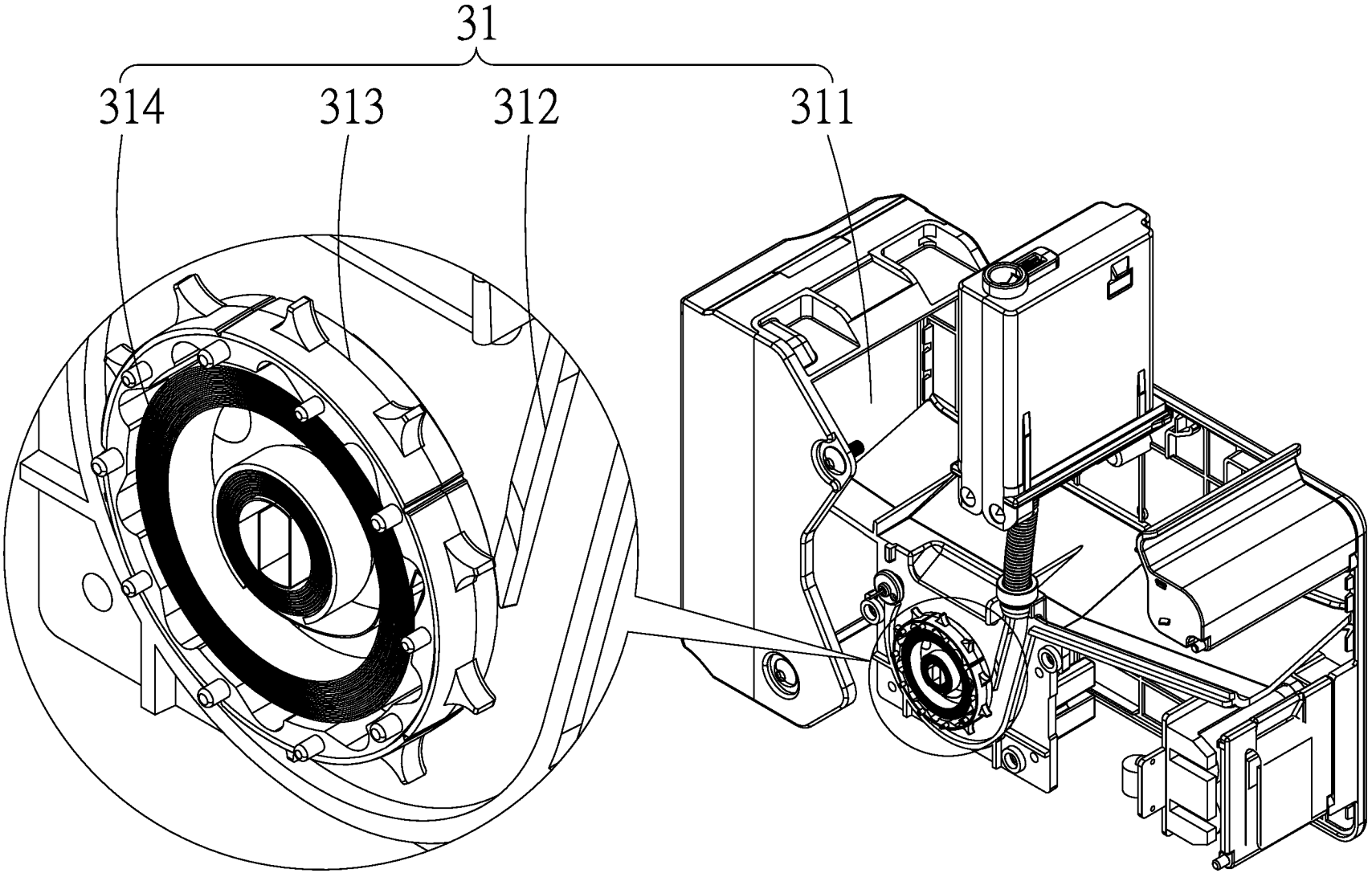
FIG. 2 is a first schematic view showing a structure of a concealed part of the first preferred embodiment of the present invention.
Figure 3:
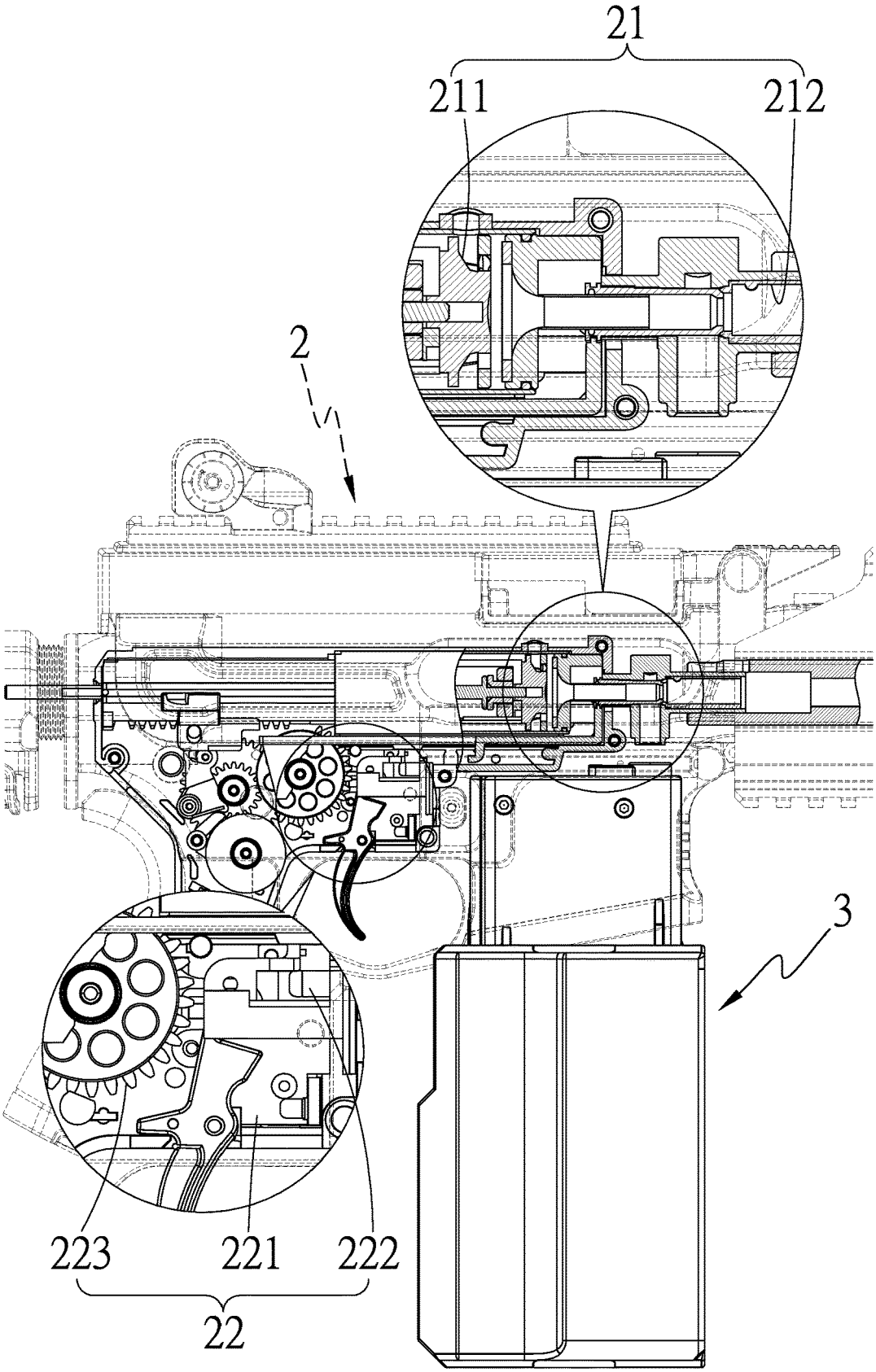
FIG. 3 is a second schematic view showing the structure of the concealed part of the first preferred embodiment of the present invention.
Figure 4:
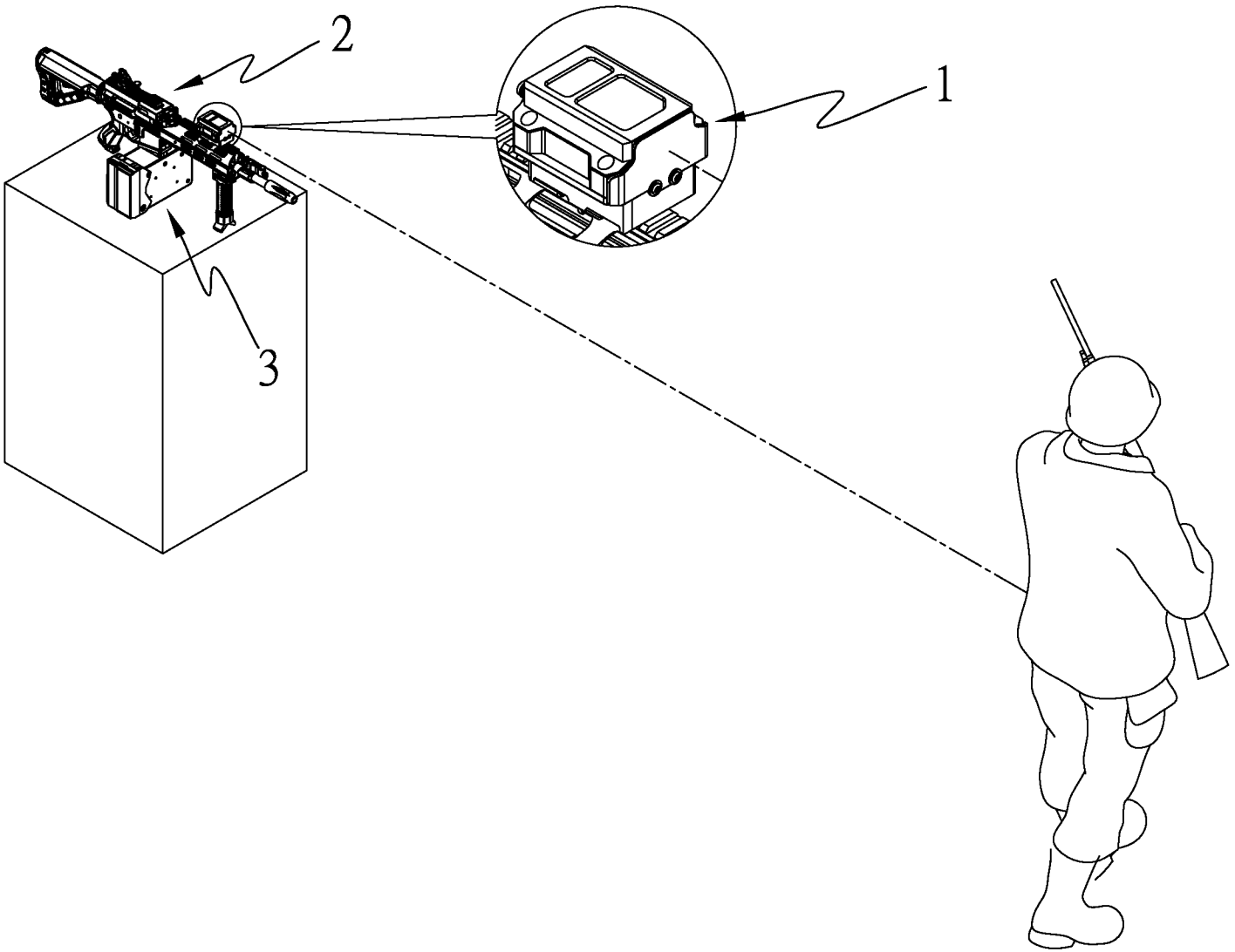
FIG. 4 is a schematic view showing detecting of the first preferred embodiment of the present invention.
Figure 5:
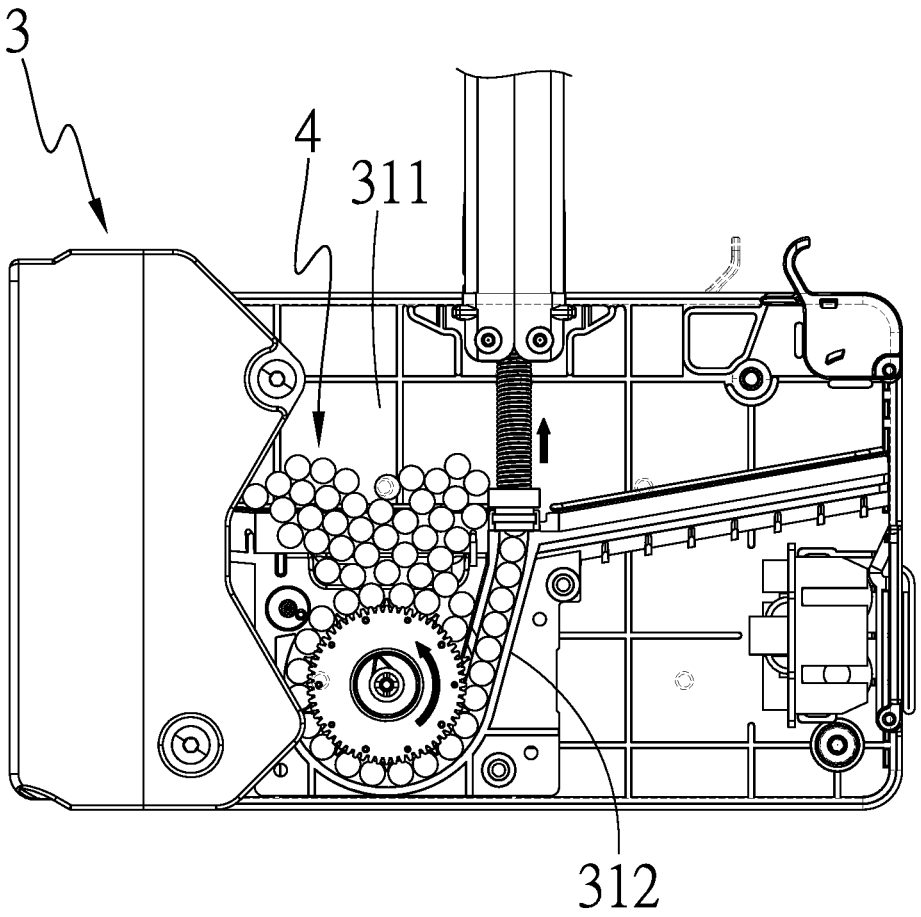
FIG. 5 is a schematic view showing shot supplying of a shot storage module of the first preferred embodiment of the present invention.

Referring to FIGS. 1-3, which are a perspective view to a second schematic view showing a structure of a concealed part of a first preferred embodiment of the present invention, it is clearly seen from the drawings that the present invention comprises:

- a laser detection device 1;
- a toy gun body 2, which is arranged at one side of the laser detection device 1 and comprises a shooting module 21 and an electronic trigger module 22 operatively connected with the shooting module 21;
- a reaction device 3, which is arranged on the toy gun body 2 and comprises:
- a shot storage module 31, which receives a plurality of shots therein;
- a control substrate 32, which is arranged at one side of the shot storage module 31 and is in information connection with the laser detection device 1 to receive a signal of detection performed by the laser detection device 1 and control the electronic trigger module 22 to drive the shooting module 21 to carry out a shooting operation, the control substrate 32 being provided with a changeover switch 323; and
- an electrical power supply unit 33, which is in electrical connection with the control substrate 32.

The laser detection device 1 can be a digital complementary metal oxide semiconductor (CMOS) laser detector or a super-miniature laser detector, but not limited thereto, and in the instant embodiment, a CMOS laser detector is taken as an example, and in the instant embodiment, the laser detection device 1 being arranged on the toy gun body 2 is taken as an example.

The shooting module 21 comprises a piston 211 for pushing and impinging the shots and a shot track 212 for shooting the shots out.

The electronic trigger module 2 includes an electronic trigger circuit board 221, an electronic trigger switch 222 in electrical connection with the electronic trigger circuit board 221, and a toothed wheel set 223 connected with the electronic trigger switch 222.

The shot storage module 31 includes a shot accommodation space 311, a shot accommodation conveyance passage 312 connected with and communicating with the shot accommodation space 311, a shot feeding unit 313 arranged at one side of the shot accommodation conveyance passage 312, and an elastic element 314 arranged in an interior of the shot feeding unit 313 for driving rotation of the shot feeding unit 313.

In the instant embodiment, a replaceable primary battery is taken as an example of the electrical power supply unit 33.

In the instant embodiment, a wind spring gear is taken as an example of the shot feeding unit 313.

In the instant embodiment, a wind spring is taken as an example of the elastic element 314.

Figure 6:
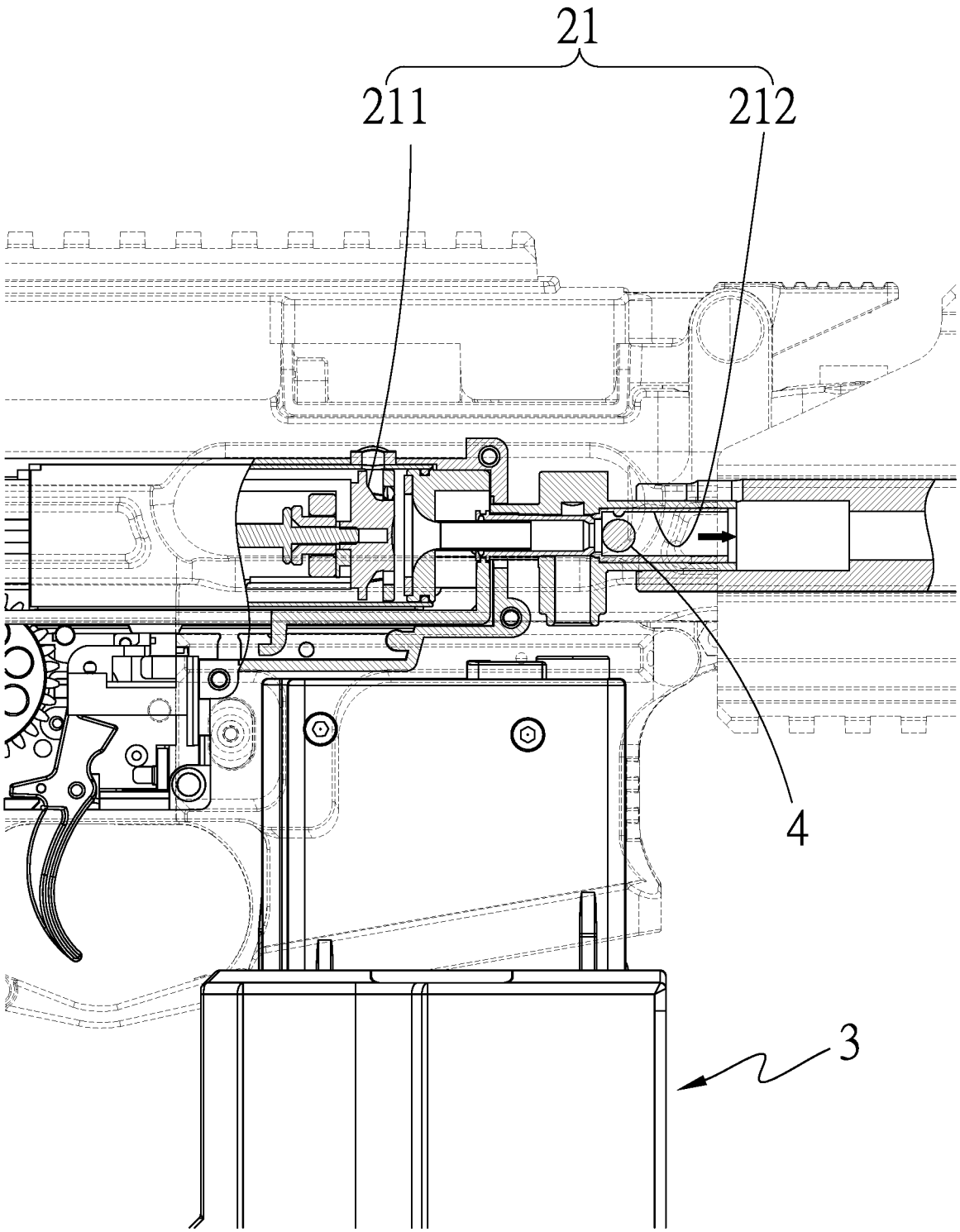
FIG. 6 is a schematic view showing firing of the first preferred embodiment of the present invention.
Figure 7:
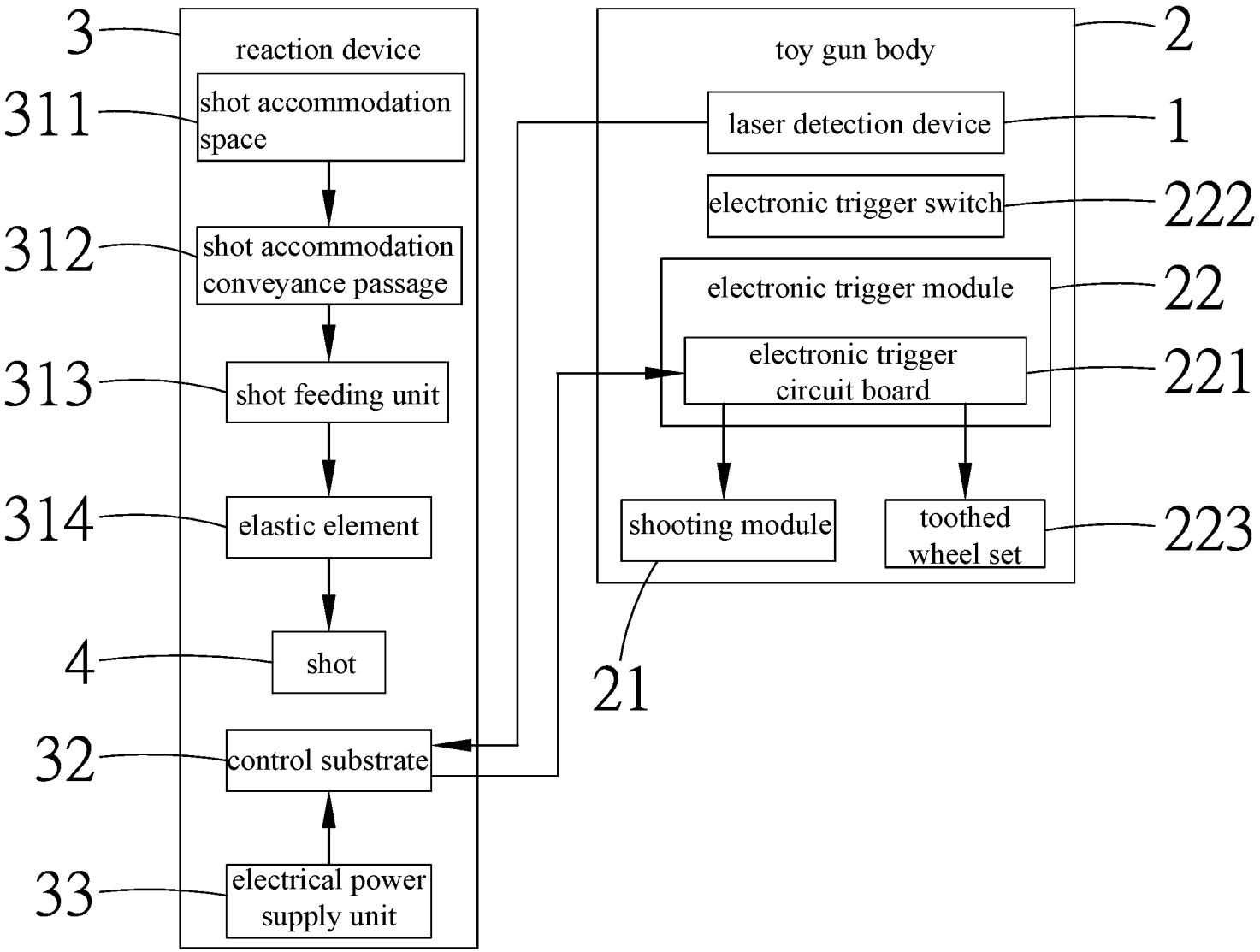
FIG. 7 is a block diagram showing an operation flow of the structure of the first preferred embodiment of the present invention.

Referring jointly to FIGS. 1-7, which are a perspective view to a block diagram of an operation flow of the structure of the first preferred embodiment of the present invention, it is clearly seen from the drawings that in the instant embodiment, an electrical gun including a battery to serve as an independent power supply source is taken as an example for the toy gun body 2, and the battery may also supply electrical power to the laser detection device 1, the electronic trigger module 22, and the shooting module 21, so that in playing a survival game, the toy gun body 2 that is installed with the reaction device 3 can be arranged in the field in advance and the electronic trigger module 22 is activated by means of the electronic trigger switch 222, and shots 4 are loaded in the shot accommodation space 311 and the shot accommodation conveyance passage 312. In this way, after the installation is completed, the reaction device 3 can be activated, and the electrical power supply unit 33 begins to supply electrical power to the control substrate 32, and the laser detection device 1 is supplied with electrical power from a battery mounted in the interior of the toy gun body 2 to carry out a detection operation (as shown in FIGS. 1 and 3-5). In this way, during the course of the game, if a target object enters a range of detection of the laser detection device 1, the laser detection device 1 immediately transmits a signal to the control substrate 32, and the control substrate 32 receives the signal and then transmits a shooting signal through a signal transmission line to the electronic trigger circuit board 221 of the electronic trigger module 22. After the electronic trigger circuit board 221 receives the shooting signal, the toothed wheel set 223 and the shooting module 21 are sequentially driven and the shots 4 contained in the shot accommodation conveyance passage 312 are pushed to forward in a direction toward the shooting module 21 due to the elastic element 314 driving the shot feeding unit 313 to rotate, and also, the shots 4 contained in the shot accommodation space 311 are fed into the shot accommodation conveyance passage 312 for consistently supplementing the shots 4 to effectively increase the cruising endurability (as shown in FIGS. 1-5). And, finally, the piston 211 of the shooting module 21 pushes the shot 4 forward to pass through the shot track 212 for shooting (as shown in FIG. 6).

Further, in case of need for change the firing mode, such as switching between single shot and repeating multiple shot, the changeover switch 323 of the control substrate 32 can be operated to change the firing mode to fulfill higher playing endurability and versatility and to suit the user's need for operation (as shown in FIG. 1).

Figure 8:
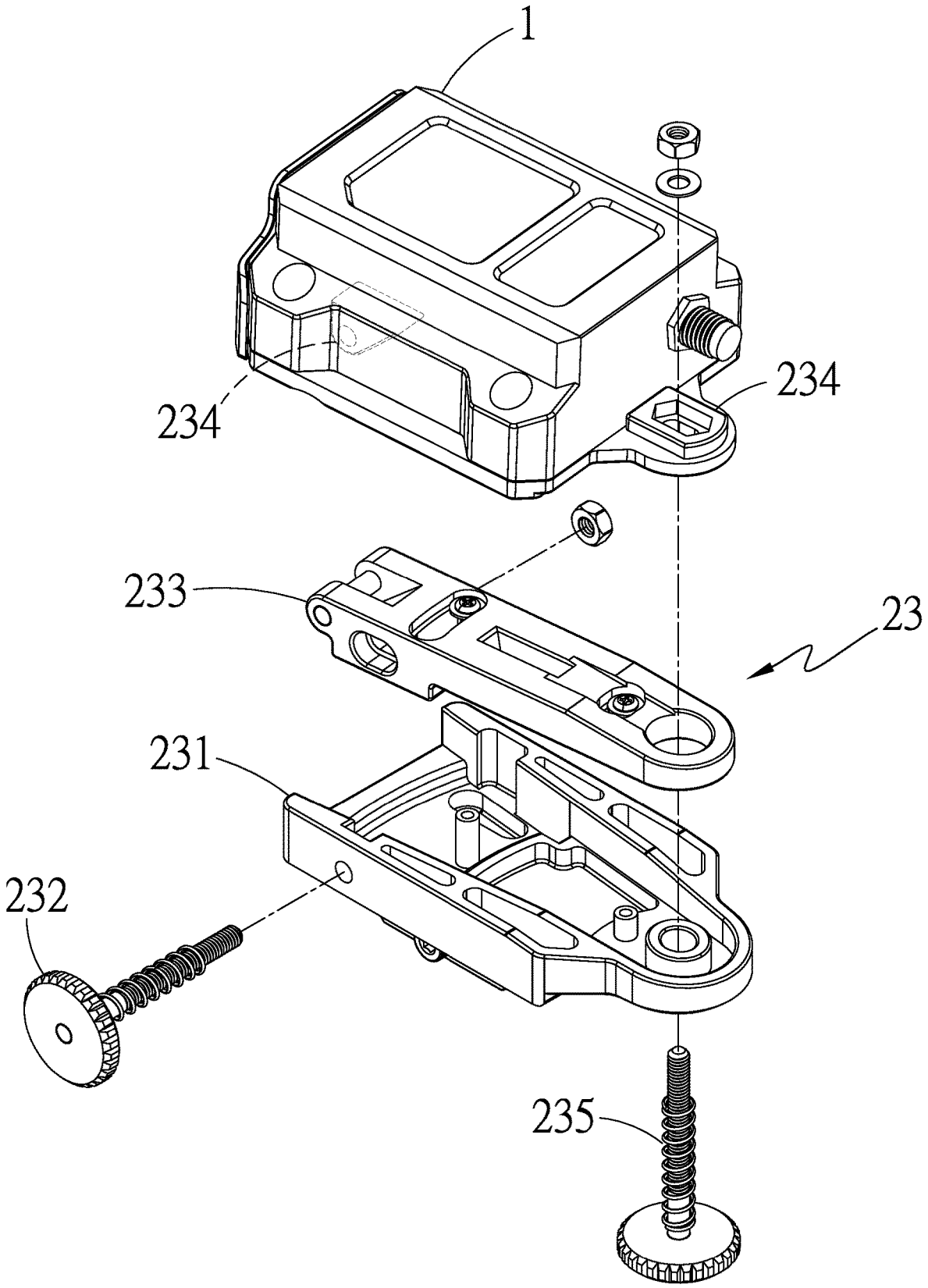
FIG. 8 is an exploded view showing an adjustment module of a second preferred embodiment of the present invention.
Figure 9A:
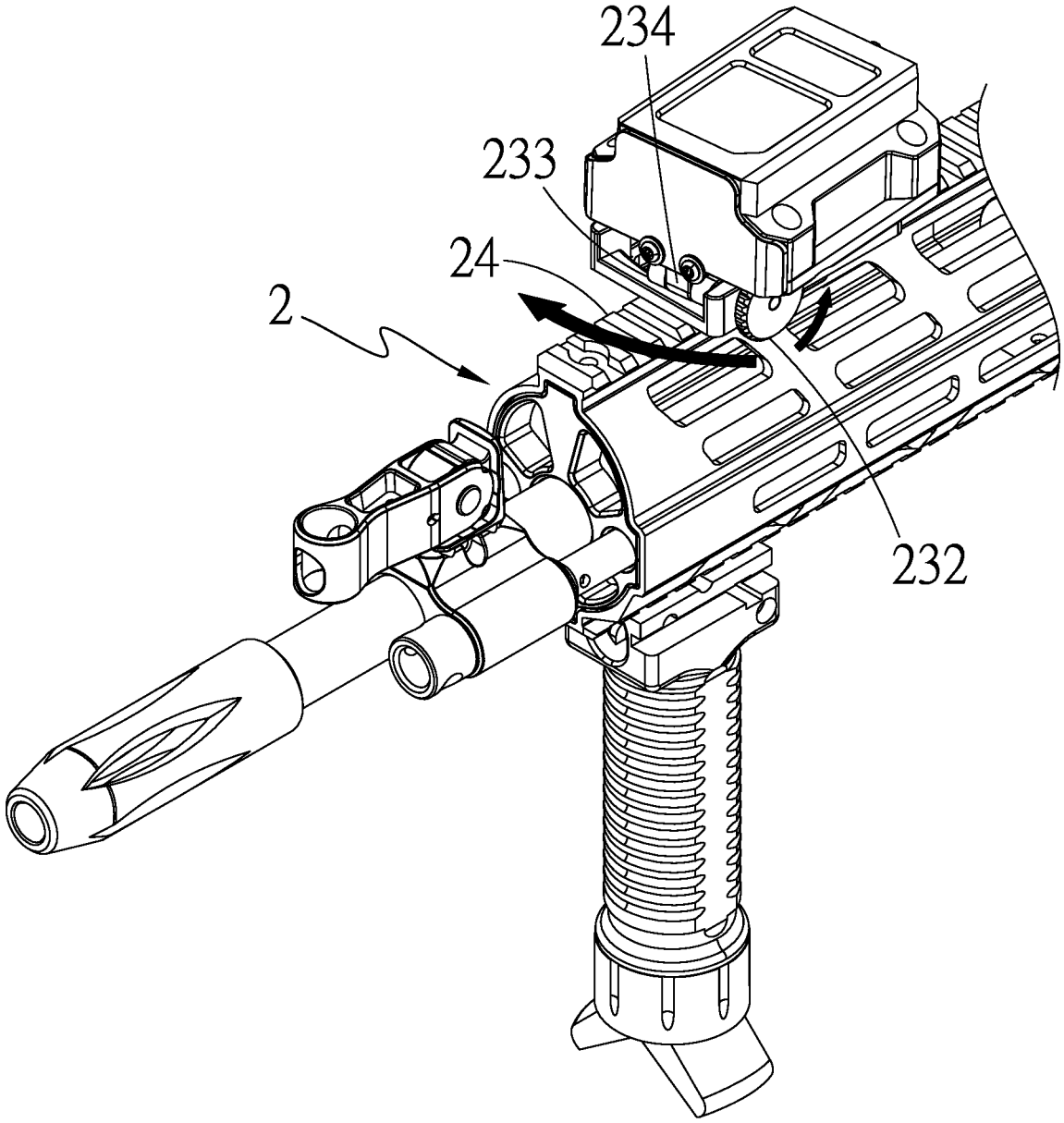
FIG. 9A is a first adjusting operation diagram of the second preferred embodiment of the present invention.
Figure 9B:
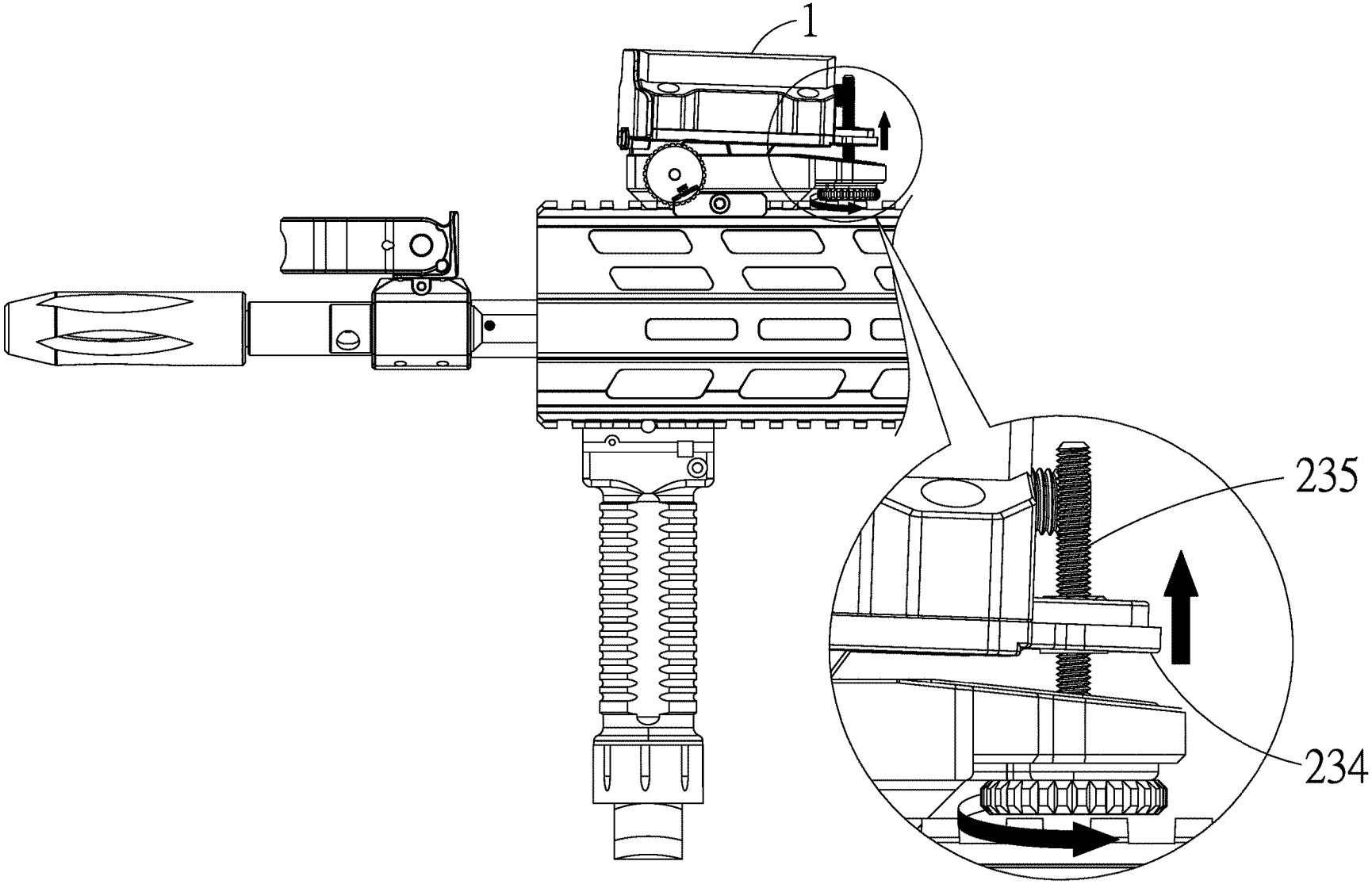
FIG. 9B is a second adjusting operation diagram of the second preferred embodiment of the present invention.

Referring to FIGS. 8-9B, which are an exploded view of an adjustment module and a second adjusting operation diagram of a second preferred embodiment of the present invention, it is clearly seen from the drawings that the toy gun body 2 is provided with an adjustment module 23, and the laser detection device 1 is arranged on the adjustment module 23 so that the laser detection device 1 becomes adjustable with respect to the position by means of the adjustment module 23. Further, the adjustment module 23 comprises a mount 231 mountable to a fishbone 24 of the toy gun body 2, a transverse adjusting member 232 pivotally connected to the mount 231, a base 233 movable on the transverse adjusting member 232, a laser detection device chassis 234 pivotally mounted on the base 233 and penetrated with the transverse adjusting member 232, and a longitudinal adjusting member 235 pivotally connected with the laser detection device chassis 234, the base 233, and the mount 231. To adjust a leftward/rightward direction of detection for the laser detection device 1, as shown in FIG. 9A, the transverse adjusting member 232 is adjusted so as to have the base 233 and the laser detection device chassis 234 driven by the transverse adjusting member 232 to do transverse movement for the leftward/rightward angle to thereby fulfill minute adjustment for the leftward/rightward detection angle, and a screw rod is taken as an example for the transverse adjusting member 232, so that by rotating the screw rod, the base 233 and the laser detection device chassis 234 are caused to move on the thread. Further, to adjust an elevation angle of detection by the laser detection device 1, as shown in FIG. 9B, the longitudinal adjusting member 235 is adjusted so as to have the laser detection device chassis 234 driven by the longitudinal adjusting member 235 to do movement for longitudinal angle to fulfill minute adjustment for upward/downward detection angle, and a screw rod is taken as an example for the longitudinal adjusting member 235, so that by rotating the longitudinal adjusting member 235, the laser detection device chassis 234 is caused to move on the thread.

Figure 10:
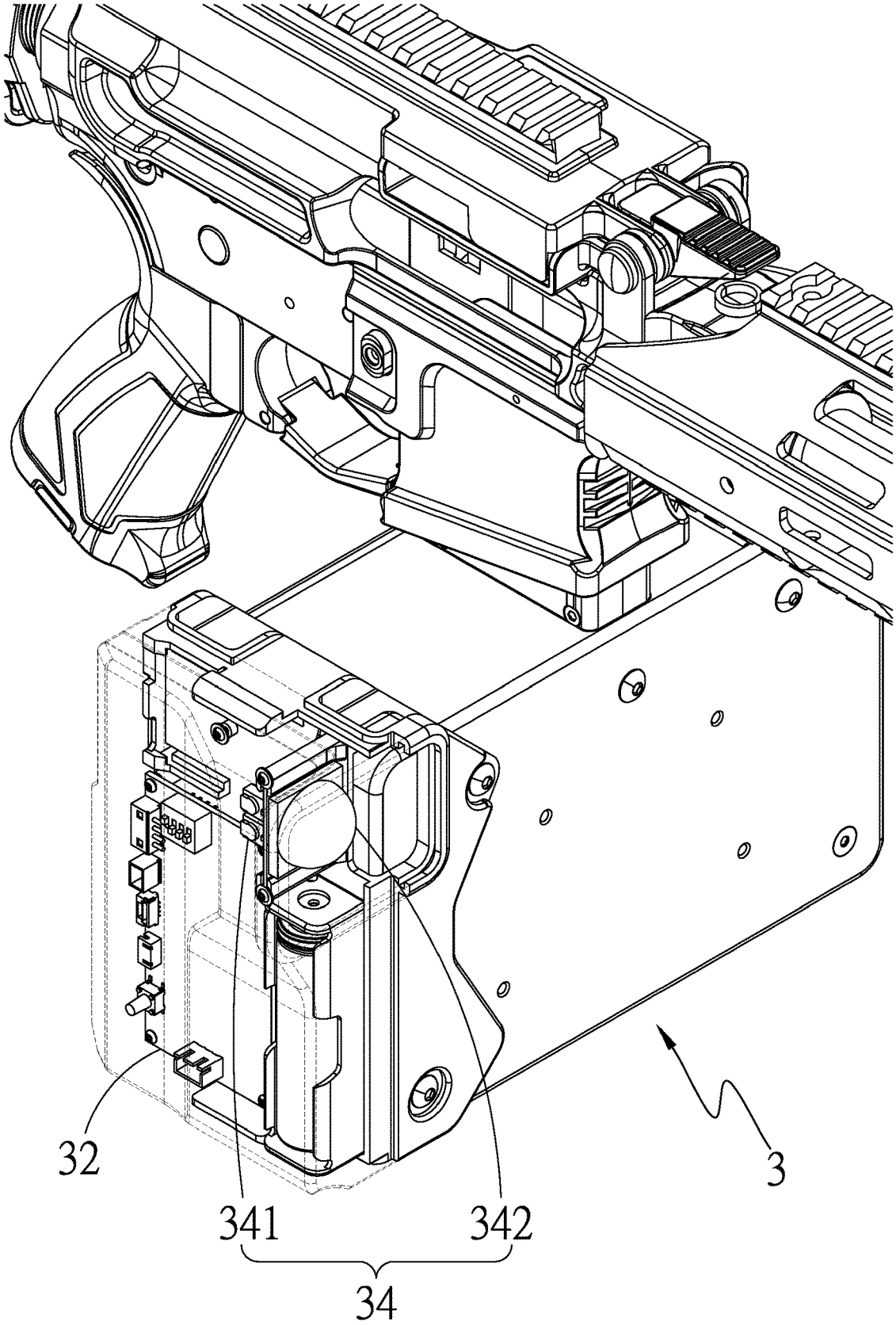
FIG. 10 is a schematic view showing an infrared detection device of a third preferred embodiment of the present invention.
Figure 11:
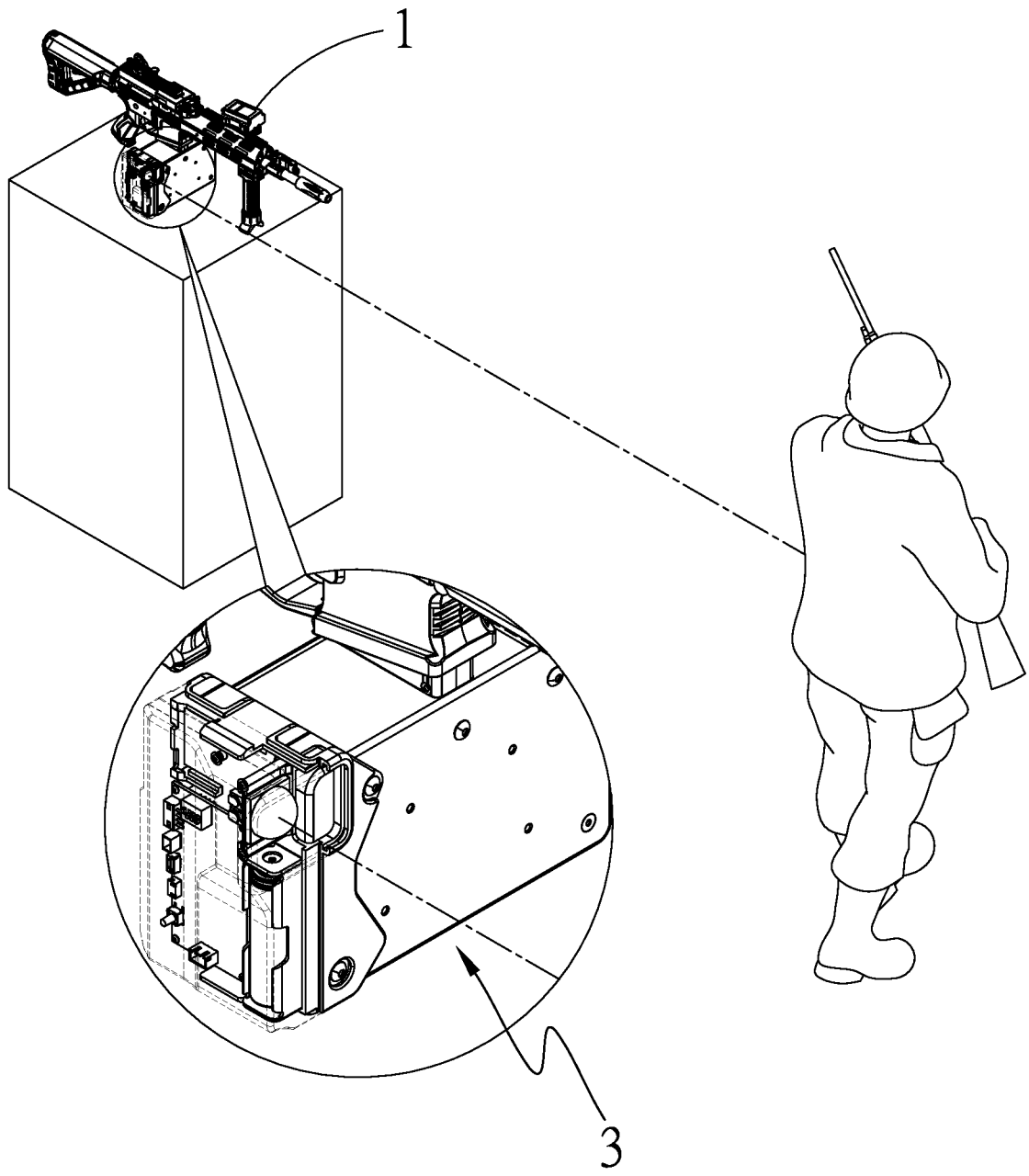
FIG. 11 is a schematic view showing operation of the infrared detection device of the third preferred embodiment of the present invention.

Referring to FIGS. 10 and 11, which are a schematic view of an infrared detection device and a schematic view showing operation of the infrared detection device of the third preferred embodiment of the present invention, it is clearly seen from the drawings that the reaction device 3 is provided with an infrared detection device 34 in information connection with the control substrate 32 to supply a detection signal to the control substrate 32 to control the electronic trigger module to drive the shooting module to carry out a shooting operation. More specifically, the infrared detection device 34 mainly comprises a human body infrared detector 341 and a Fresnel lens 342 arranged at one side of the human body infrared detector 341, and thus, in addition to detection of a target object implemented with the laser detection device 1, the present invention also enables detection implemented in combination with the infrared detection device 34, so that when a target object enters a range of detection of the human body infrared detector 341, a signal is transmitted to the control substrate 32 to allow the control substrate 32 to control the electronic trigger module to drive the shooting module to carry out a shooting operation. Further, the Fresnel lens 342 is structured to have a short focus length and, as compared to ordinary lenses, exhibits advantages of including a reduced amount of material, a decreased weight, and a smaller size.

Figure 12:
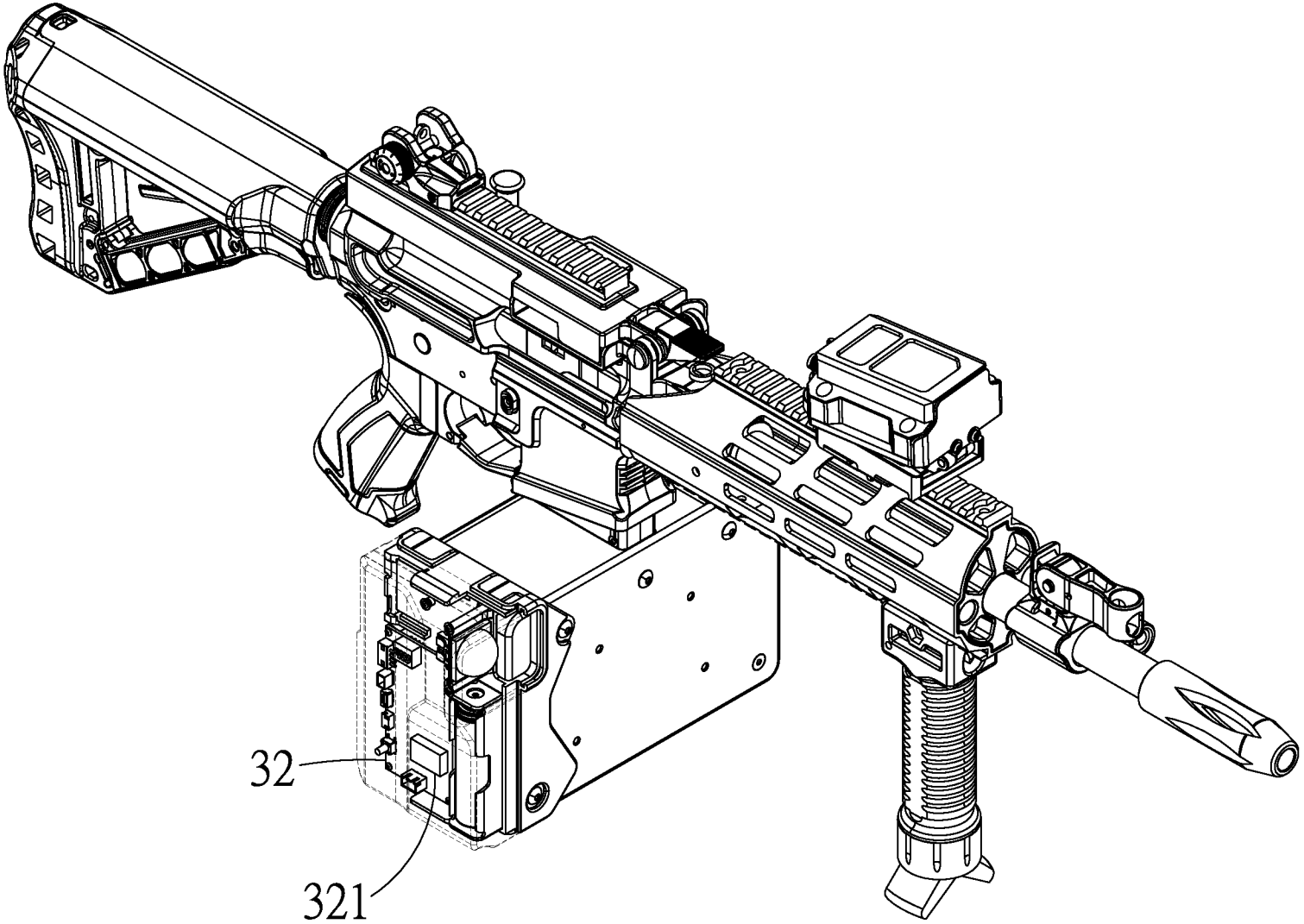
FIG. 12 is a schematic view showing a wireless receiver module of a fourth preferred embodiment of the present invention.
Figure 13:
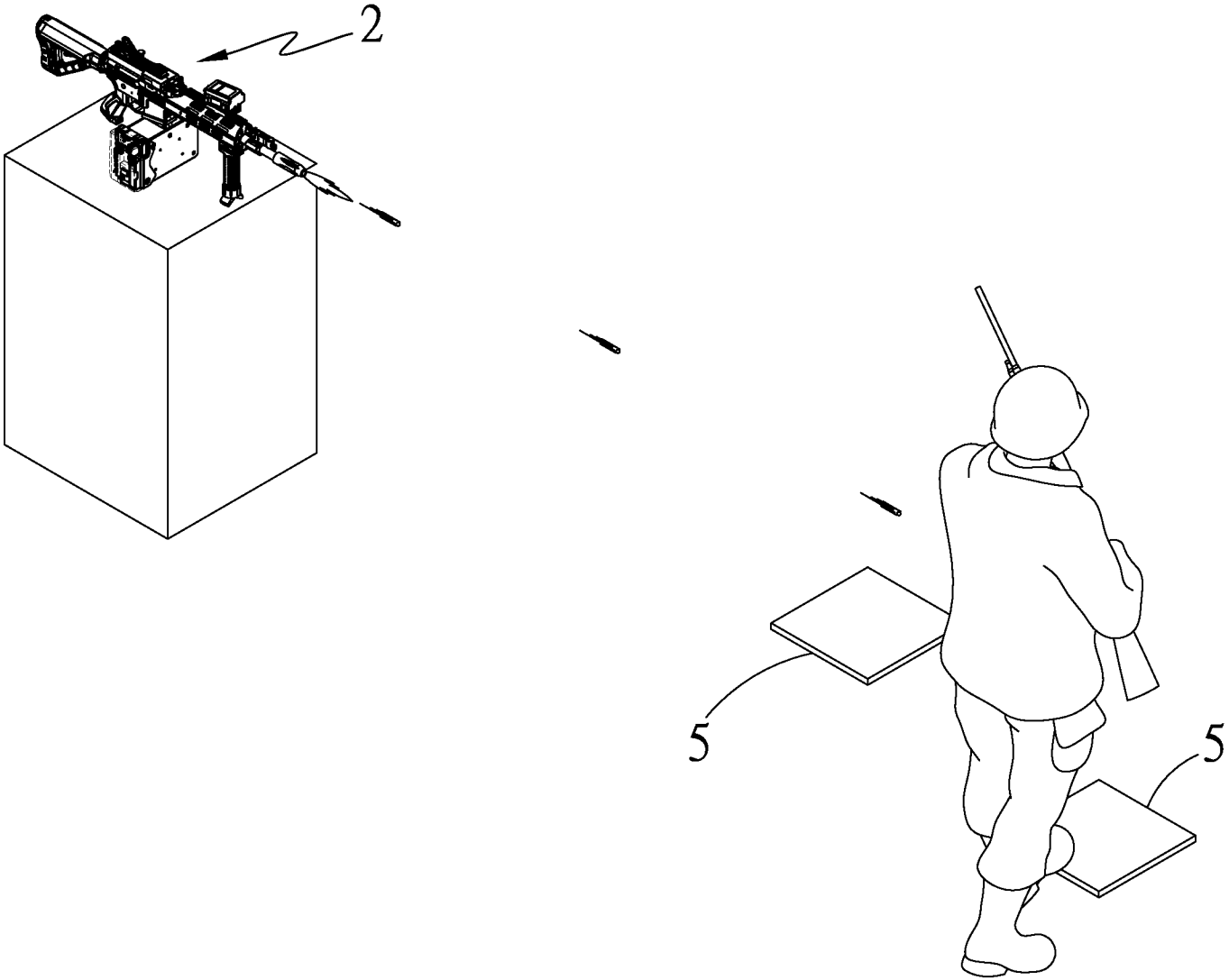
FIG. 13 is a schematic view showing a pressure board of the fourth preferred embodiment of the present invention.
Figure 14:
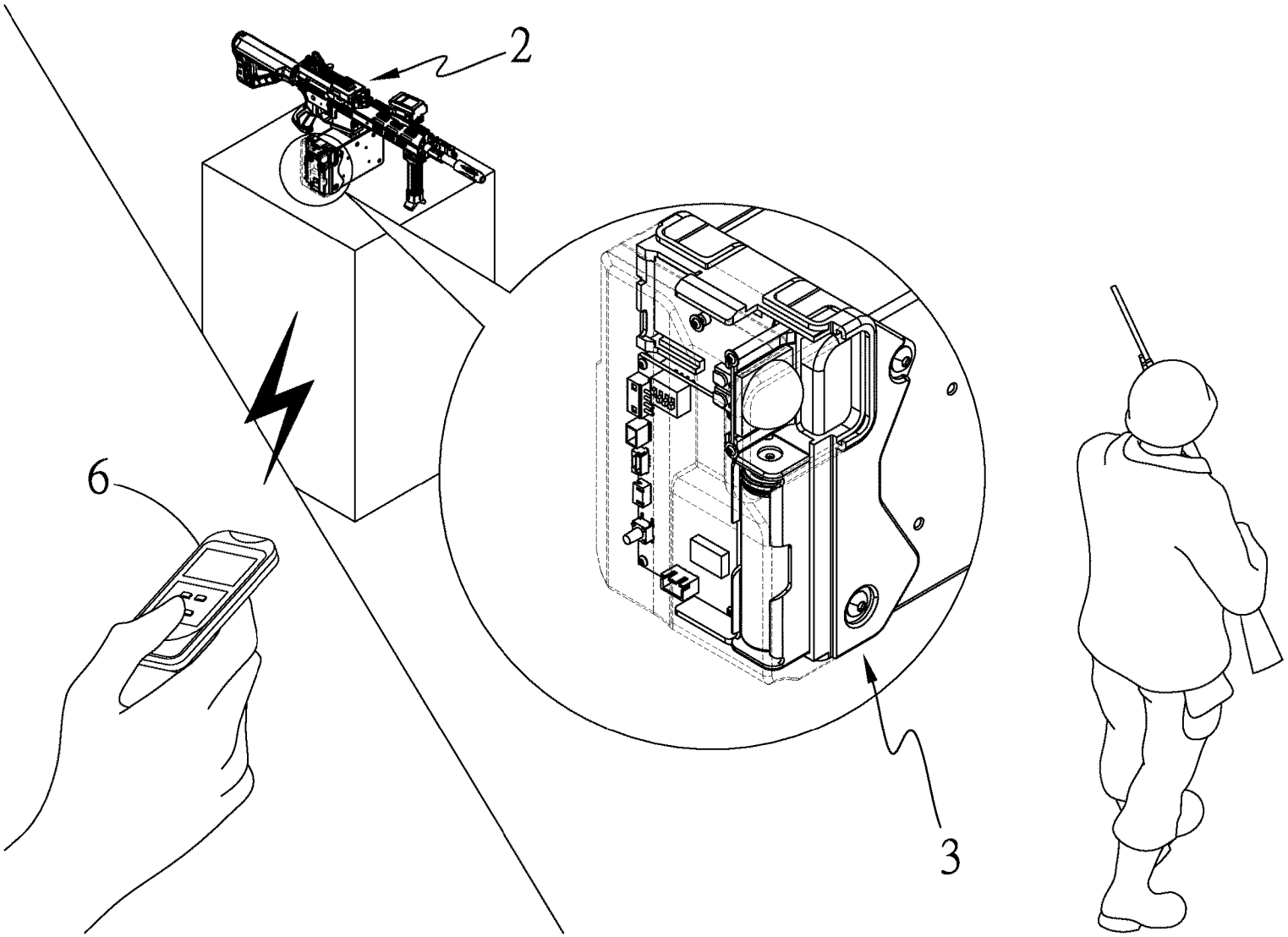
FIG. 14 is a schematic view showing a remote controller of the fourth preferred embodiment of the present invention.

Referring to FIGS. 12-14, which are a schematic view of a wireless receiver module to a schematic view of a remote controller of the fourth preferred embodiment of the present invention, it is clearly seen from the drawings that the control substrate 32 is provided with a wireless receiver module 321 arranged thereon to receive a control signal and controls the electronic trigger module for driving. More specifically, the wireless receiver module 321 is in wireless information connection with at least one pressure board 5, and in the instant embodiment, an arrangement of two pressure boards 5 is taken as an example for illustration, and connection is achieved with a communication protocol, such as Bluetooth, WIFI, or infrared light, and the pressure boards 5 are arranged on a moving path of a target object. In other words, when the target object step on the pressure boards 5, the pressure boards 5 immediately give off a firing signal to be received by the wireless receiver module 321, and the wireless receiver module 321 then transmits the firing signal to the control substrate 32, so that the control substrate 32 controls the electronic trigger module to drive the shooting module to carry out a shooting operation to achieve an effect of automatic counterattack (as shown in FIGS. 12 and 13). Of course, operation in an opposite fashion is also feasible, in which the pressure boards 5 serve to supply a signal for stopping shooting of the toy gun body 2. Further, the wireless receiver module 321 may be in wireless information connection with a remote controller 6, and the connection is similarly achieved with a communication protocol, such as Bluetooth, WIFI, or infrared light, and the remote controller 6 is operated by a user to control the toy gun body 2 at a remote site. In other words, when the user operates the remote controller 6 to make the toy gun body 2 shooting, the remote controller 6 transmits a firing signal to be received by the wireless receiver module 321, and the wireless receiver module 321 then transmits the firing signal to the control substrate 32, so that the control substrate 32 controls the electronic trigger module to drive the shooting module to carry out a shooting operation to thereby achieve an effect of manual counterattack, or using the remote controller 6 to activate or deactivate the reaction device 3, or using the remote controller 6 to change the shooting mode (as shown in FIGS. 12 and 14).

Figure 15:
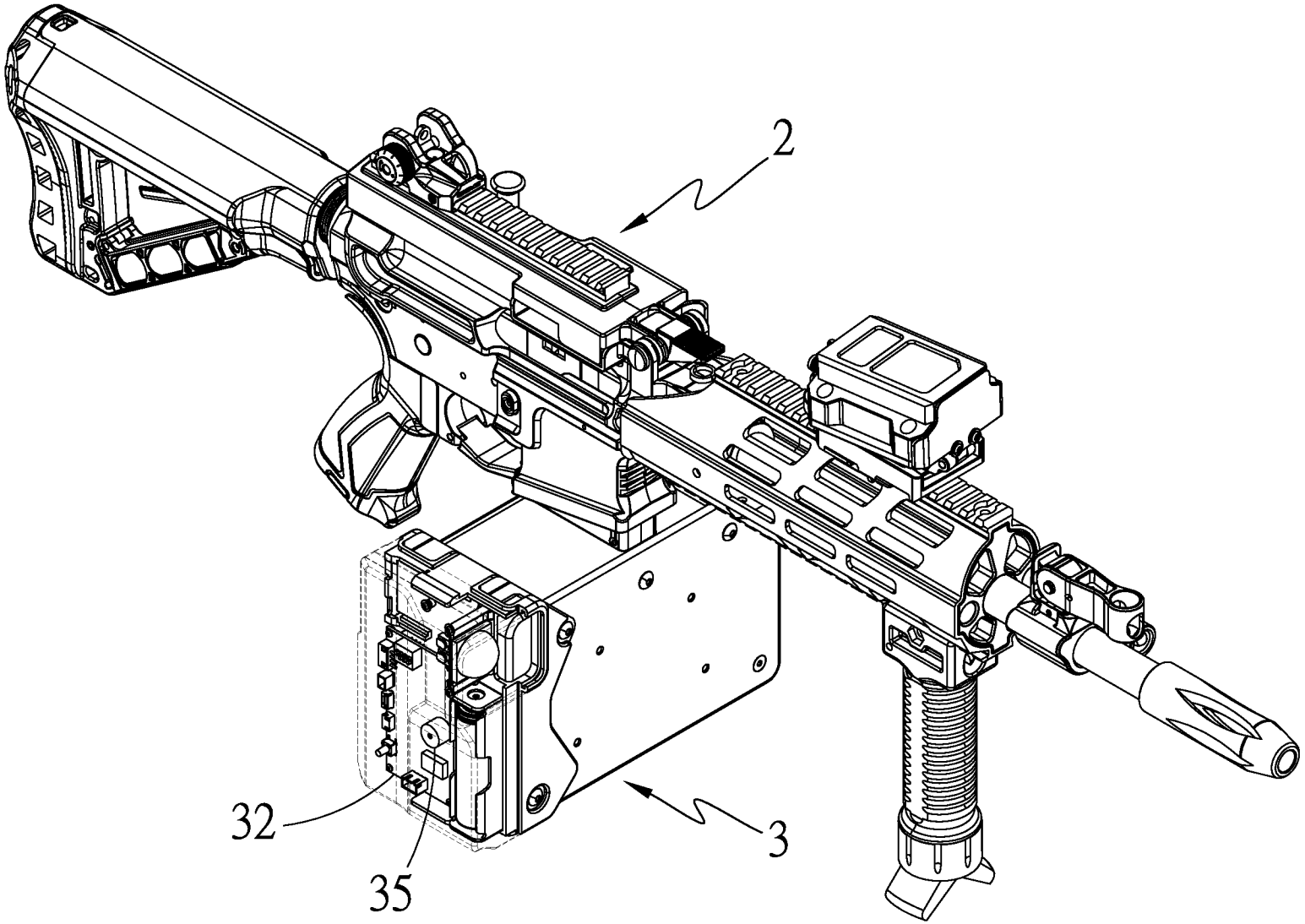
FIG. 15 is a schematic view showing a loudspeaker device of a fifth preferred embodiment of the present invention.

Referring to FIG. 15, which is a schematic view showing a loudspeaker device of a fifth preferred embodiment of the present invention, it is clearly seen from the drawing that the control substrate 32 is provided with a loudspeaker device 35 for giving off sounding corresponding to a status of the control substrate 32. More specifically, when the control substrate 32 is operated in an abnormal condition, the loudspeaker device 35 issues an alarm sound to notify the user that the reaction device 3 is currently in a malfunctioning condition, so that the user may carry out repairing and servicing immediately to prevent device down and inoperability during the course of the game, which may result in reduction of interesting of game playing. Further, the loudspeaker device 35 may give off indicating sounding for settings in case of adjusting the firing mode or other setting of the toy gun body 2, so that the user may easily identify the current condition. However, the functionality of the loudspeaker device 35 may not be limited to the above scenarios, and other conditions are also considered within the scope of protection that the present invention is pursuing.

Figure 16:
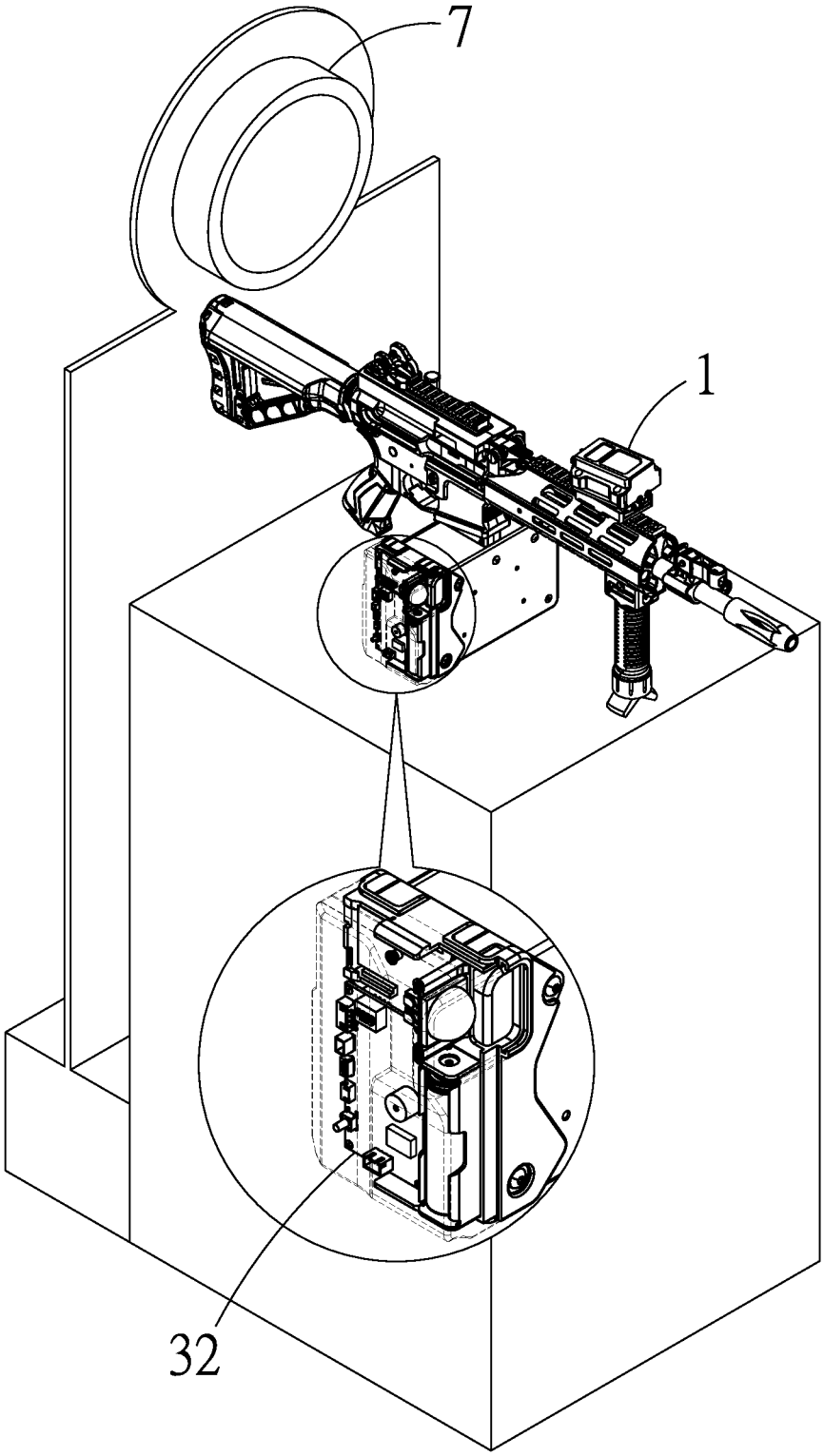
FIG. 16 is a schematic view showing an electronic target of a sixth preferred embodiment of the present invention.

Referring to FIG. 16, which is a schematic view showing an electronic target of a sixth preferred embodiment of the present invention, it is clearly seen from the drawing that the control substrate 32 is in information connection with an electronic target 7, so that the electronic target 7 may control the operation of the control substrate 32 of the present invention. More specifically, the electronic target 7 is set in information connection with the control substrate 32 in a wired or wireless manner, where the wired manner indicates a signal transmission line, while the wireless manner indicates a communication protocol, such as Bluetooth, WIFI, or infrared light. Under a condition that the user misses the electronic target 7, the laser detection device 1 continuously detects the user on the front side, and when the user enters the detection area, the toy gun body 2 starts to shoot, and if the user hits the electronic target 7, the electronic target 7 immediately transmits a hitting signal to the control substrate 32, and the control substrate 32 then controls the laser detection device 1 to stop detection, and the shooting module stops operation, providing a way of playing that is different from a regular survival game.

Figure 17:
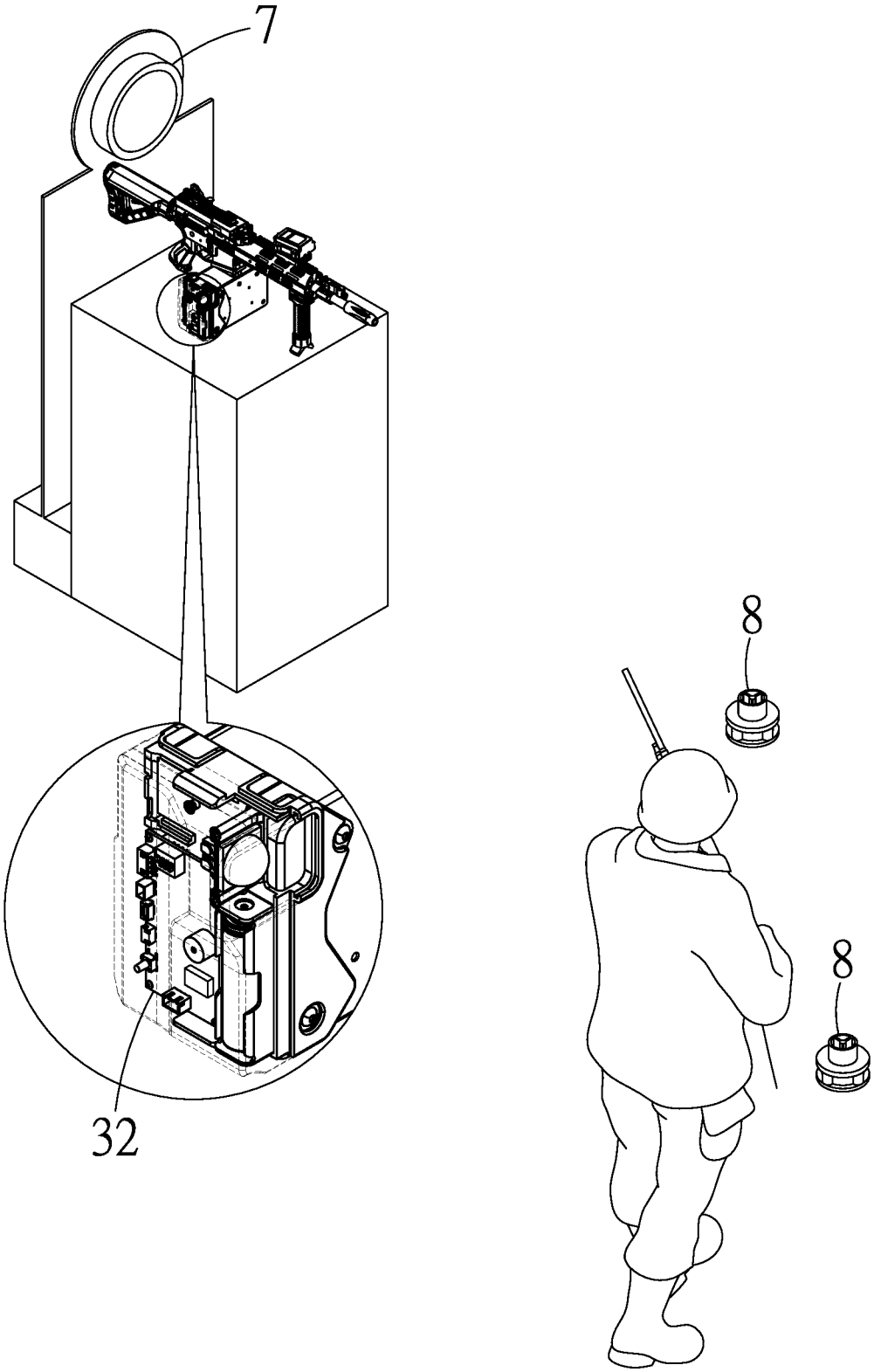
FIG. 17 is a schematic view showing an electronic detonator device of a seventh preferred embodiment of the present invention.

Referring to FIG. 17, which is a schematic view showing an electronic detonator device of a seventh preferred embodiment of the present invention, it is clearly seen from the drawing that the control substrate 32 is in information connection with at least one electronic detonator device 8, and in the instant embodiment, an arrangement of multiple ones of the electronic detonator device 8 is taken as an example for illustration. The electronic detonator devices 8 stop operation according to a signal issued from the electronic target 7 to the control substrate 32. More specifically, in the instant embodiment, a booby mine is taken as an example for the electronic detonator device 8, and the booby mine can be a mine exhibiting sounding and lighting effects, so that under the condition that the user misses the electronic target 7, the electronic detonator device 8 will be activated within a predetermined period of time to have the electronic detonator device 8 generates strong light or great explosion sounding effect, and if the user hits the electronic target 7, the control substrate 32 transmits a stopping signal to the electronic detonator device 8 to stop the operation thereof. In this way, another way of playing the game is provided, and the interesting of game playing may be effectively enhanced.

Figure 18:
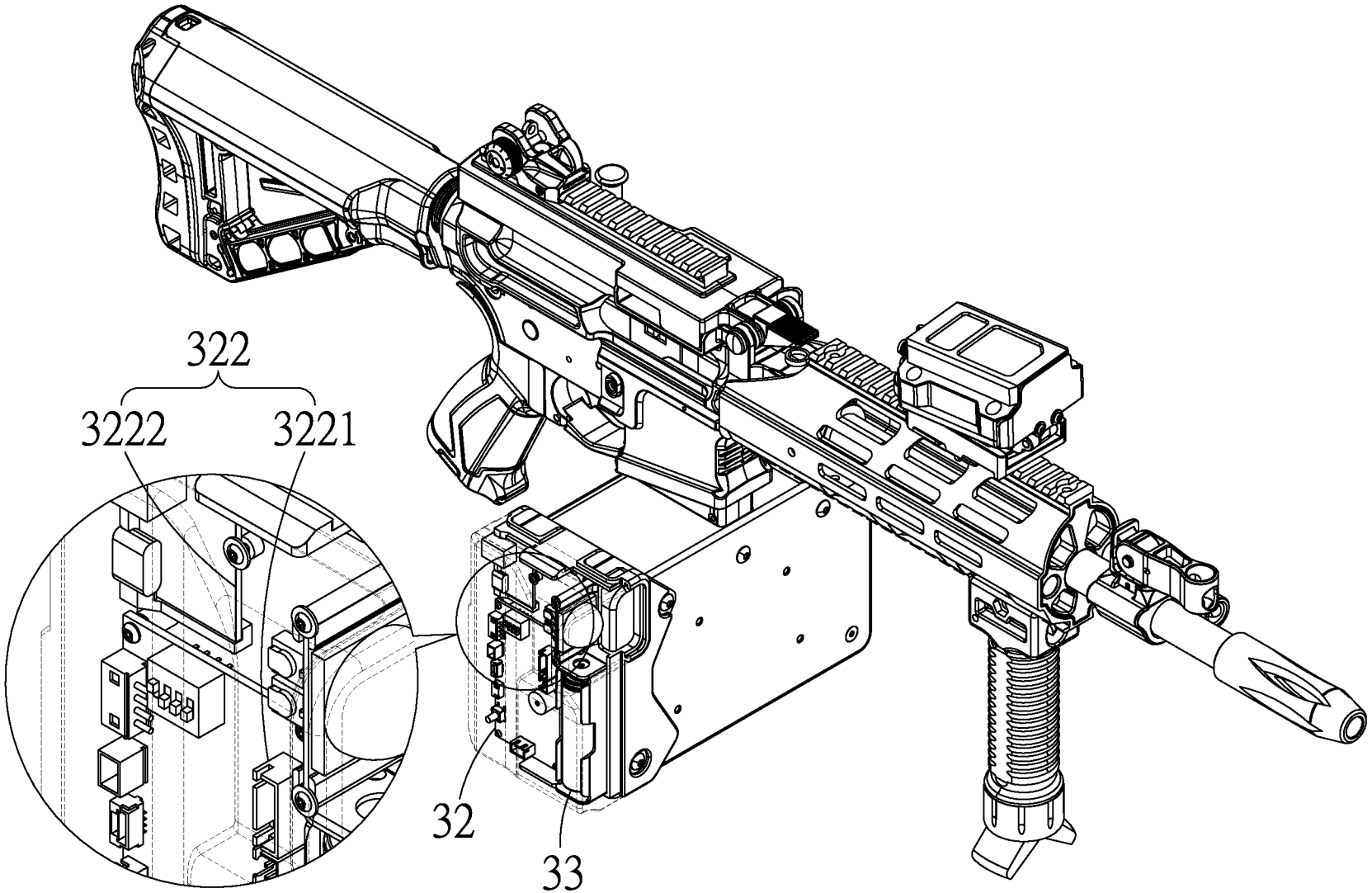
FIG. 18 is a schematic view showing a charging module of an eighth preferred embodiment of the present invention.

Referring to FIG. 18, which is a schematic view showing a charging module of an eighth preferred embodiment of the present invention, it is clearly seen from the drawing that the control substrate 32 is provided with a charging module 322 that is in electrical connection with the electrical power supply unit 33. More specifically, the charging module 322 comprises a connector 3221 in electrical connection with the control substrate 32 and a charger board module 3222 in electrical connection with the control substrate 32. In the instant embodiment, a rechargeable battery is taken as an example for the electrical power supply unit 33. When the electrical power supply unit 33 consumes up the electrical power thereof, a charging cable is connected to the connector 3221, and charging to the electrical power supply unit 33 is carried out with the charger board module 3222, so that the present invention assures an advantage of environmental friendliness by using a repeatedly rechargeable/dischargeable electrical power supply unit 33.

Figure 19:
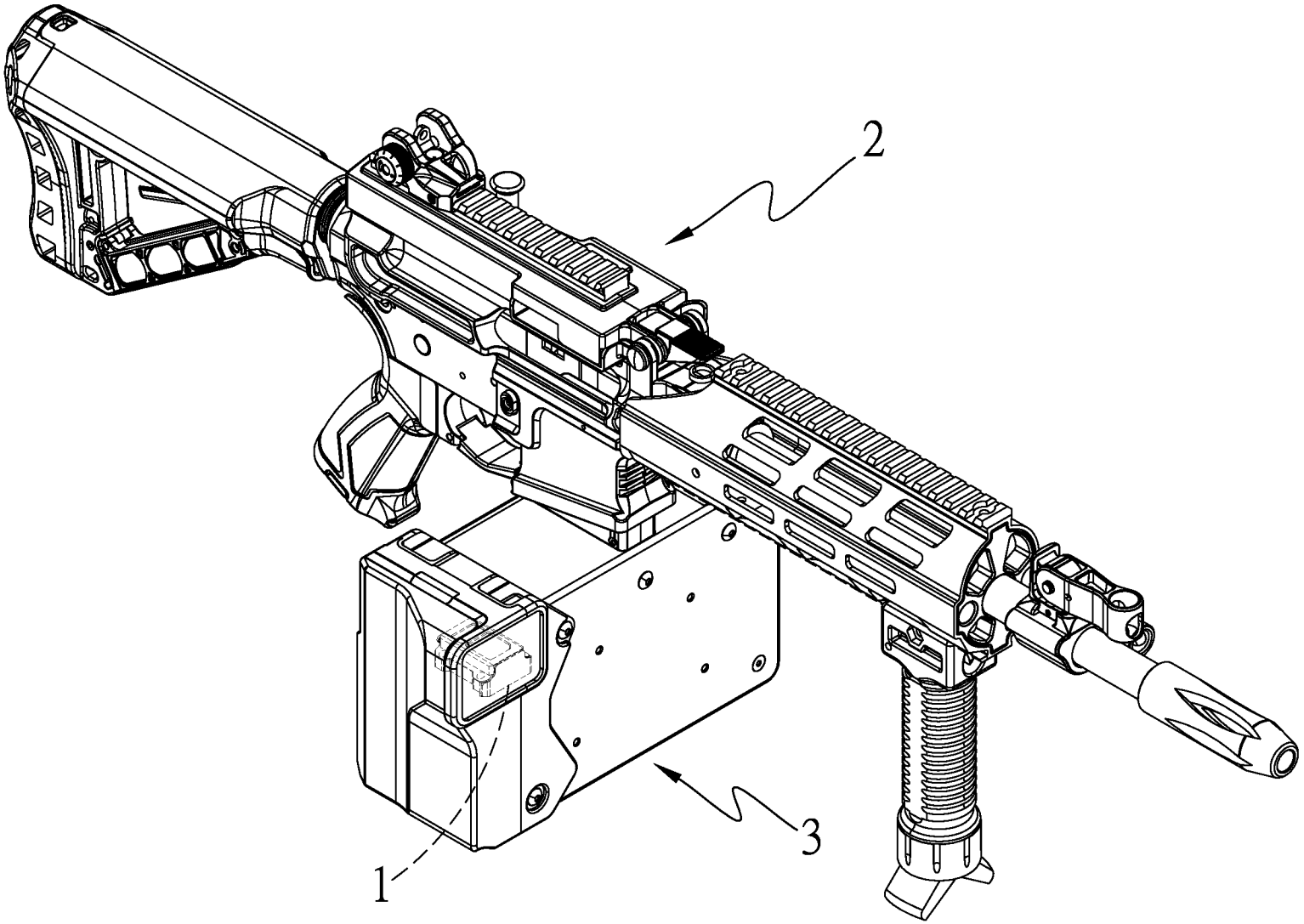
FIG. 19 is a schematic view showing a charging module of an ninth preferred embodiment of the present invention.

Referring to FIG. 19, which is a schematic view showing implementing of a ninth preferred embodiment of the present invention, it is clearly seen from the drawing that the instant embodiment is different from the previous embodiments in that in the instant embodiment, the laser detection device is arranged on the reaction device 3, rather than being arranged on the toy gun body 2, meaning the present invention does not limit the location where the laser detection device 1 may be arranged, provided detection of the position of a target object can be properly performed.

Figure 20:
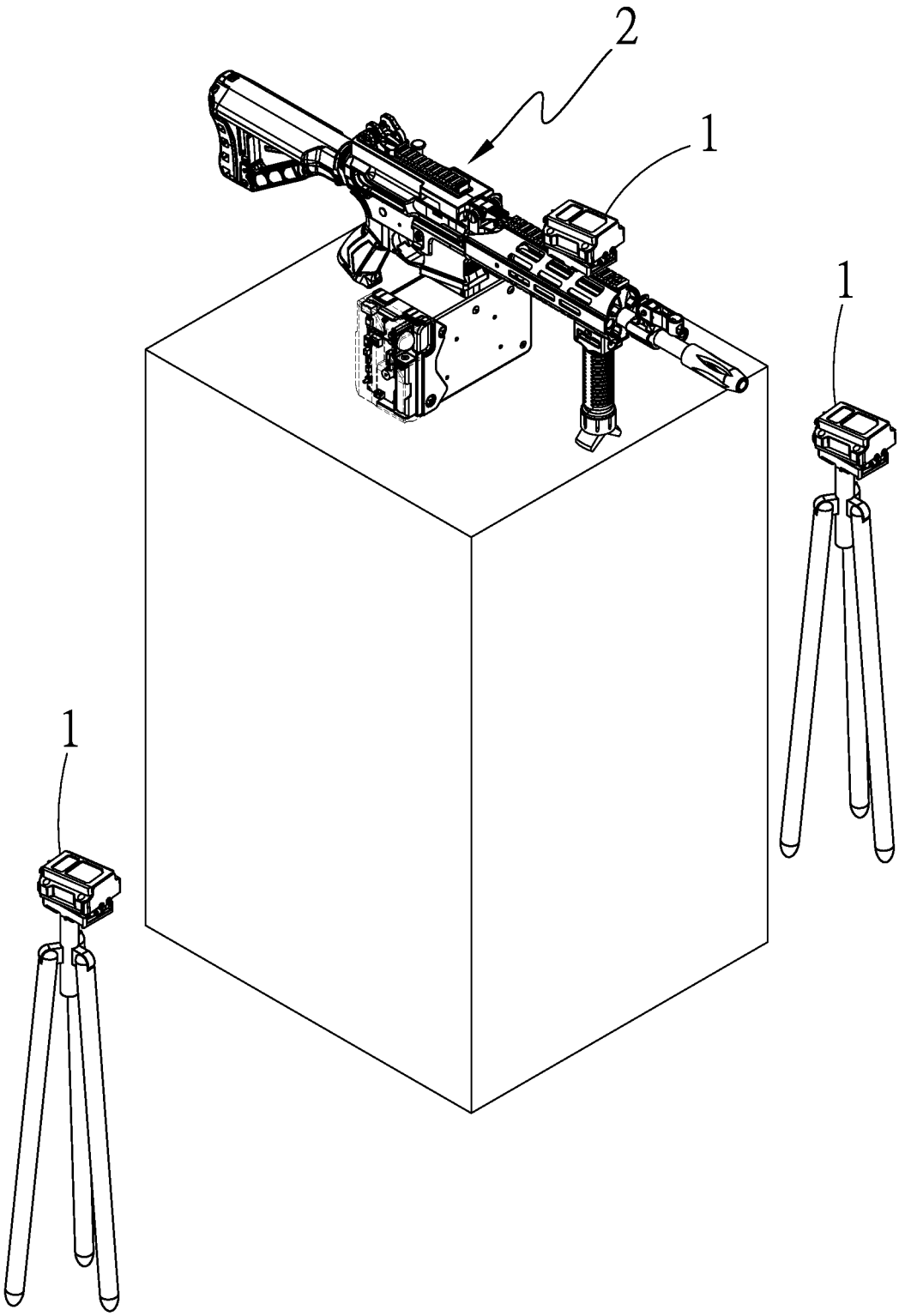
FIG. 20 is a schematic view showing implementing of a tenth preferred embodiment of the present invention.

Referring to FIG. 20, which is a schematic view showing implementing of a tenth preferred embodiment of the present invention, it is clearly seen from the drawing that the instant embodiment is different from the previous embodiments in that in the instant embodiment, the arrangement of the laser detection device 1 includes multiple ones, which include, in addition to the laser detection device 1 that is arranged on the toy gun body 2, a number of additional laser detection devices 1 that are arranged in the periphery, all being in information connection with the control substrate in order to increase the range of detection for being closer to a real human being scenario to increase the difficulty of the game and enhance the degree of challenge thereof.

Thus, referring to all the drawings, the present invention, when compared with the prior art, truly shows the following advantages in the use thereof:

Firstly, the laser detection device 1 is provided for effectively increasing the accuracy and range of detection to fulfill a more realistic scenario and to control the electronic trigger module 22 to drive the shooting module 21 to carry out a shooting operation, accomplishing a different way of playing a survival game. Further, the arrangement of the electronic trigger module 22 makes reaction sensitivity faster and enables change of the firing mode according to a user's need to make the playing persistency higher.

Secondly, the arrangement of the electronic trigger switch 222 allows the user to set and change the firing mode by oneself to fulfill better playing persistency and versatility, and to suit the user's need for operation.

Thirdly, the combination of the shot accommodation space 311 and the shot accommodation conveyance passage 312 forms a shot drum mode and significantly increase the capacity of accommodating shots to increase the endurability and to allow the user not to frequently supplement the shots 4.

Fourthly, the adjustment module 23 makes it possible to adjust the direction in which the laser detection device 1 or the distance thereof according to the field condition or the user's need to fulfill widened flexibility of arrangement.

Fifthly, the combination of the infrared detection device 34 and the laser detection device 1 helps improve accuracy of detection.

Sixthly, the arrangement of the wireless receiver module 321 allows the user to implement remote control and can be used in combination with accessories, such as the pressure board 5, to provide diversified ways of game playing to thereby enhance the interesting of game playing.

Seventhly, the arrangement of the loudspeaker device 35 allows the user do repairing and serving immediately so as to prevent device down and malfunctioning during the course of game playing that may result in lowering of game playing, and enables easy identification of the current status.

Eighthly, the arrangements of the electronic target 7 and the electronic detonator device 8 provide ways of playing that are different from the known survival games.

Ninthly, the present invention provides the charging module 322 to enable charging to the electrical power supply unit 33 when the electrical power supply unit 33 consumes up the electrical power thereof, and assures an advantage of environmental friendliness through repeated recharging/discharging.

I claim:

1. A toy gun automatic shooting device, mainly comprising:

a laser detection device, which detects whether a target object enters a range of detection of the laser detection device;

a toy gun body, which is arranged at one side of the laser detection device and comprises a shooting module and an electronic trigger module operatively connected with the shooting module; and a reaction device, which is arranged on the toy gun body and comprises:

a shot storage module, which receives therein a plurality of shots, a control substrate, which is arranged at one side of the shot storage module and is in information connection with the laser detection device to receive a signal of detection by the laser detection device and control the electronic trigger module to drive the shooting module to carry out a shooting operation, wherein the control substrate comprises a loudspeaker device to give off sounding corresponding to a status of the control substrate, and an electrical power supply unit, which is in electrical connection with the control substrate, wherein, when the laser detection device detects the target object enters the range of detection of the laser detection device, the laser detection device immediately transmits the signal of detection to the control substrate, and the control substrate receives the signal of detection and then transmits a shooting signal to control the electronic trigger module to drive the shooting module to carry out a shooting operation.

2. The toy gun automatic shooting device according to claim 1, wherein the electronic trigger module comprises an electronic trigger circuit board, an electronic trigger switch in electrical connection with the electronic trigger circuit board, and a toothed wheel set connected with the electronic trigger switch.

3. The toy gun automatic shooting device according to claim 1, wherein the shot storage module includes a shot accommodation space, a shot accommodation conveyance passage connected to and communicating with the shot accommodation space, and an elastic element is arranged in the shot accommodation conveyance passage.

4. The toy gun automatic shooting device according to claim 1, wherein the toy gun body is provided with an adjustment module, and the laser detection device is arranged on the adjustment module so that the laser detection device is adjustable with respect to a position thereof by means of the adjustment module.

5. The toy gun automatic shooting device according to claim 1, wherein the reaction device comprises an infrared detection device in information connection with the control substrate to supply a detection signal to the control substrate to control the electronic trigger module to drive the shooting module to carry out a shooting operation.

6. The toy gun automatic shooting device according to claim 1, wherein the control substrate comprises a wireless receiver module to receive a control signal and control the electronic trigger module for driving.

7. The toy gun automatic shooting device according to claim 1, wherein the control substrate is in information connection with an electronic target, so that the electronic target controls operation of the control substrate.

8. The toy gun automatic shooting device according to claim 7, wherein the control substrate is in information connection with an electronic detonator device, and the electronic detonator device stops operation according to a signal issued from the electronic target to the control substrate.

9. The toy gun automatic shooting device according to claim 1, wherein the control substrate is provided with a charging module in electrical connection with the electrical power supply unit.

* * * * *